US009058731B2

(12) United States Patent
Andrews et al.

(10) Patent No.: US 9,058,731 B2
(45) Date of Patent: Jun. 16, 2015

(54) SMOKE DETECTOR WITH AIRFLOW BARRIER

(71) Applicant: SimplexGrinnell LP, Westminster, MA (US)

(72) Inventors: Alexander Singer Andrews, Clinton, MA (US); Donald Dunn Brighenti, Westminster, MA (US)

(73) Assignee: Tyco Fire & Security GmbH, Neuhausen am Rheinfall (CH)

( * ) Notice: Subject to any disclaimer, the term of this patent is extended or adjusted under 35 U.S.C. 154(b) by 10 days.

(21) Appl. No.: 14/047,938

(22) Filed: Oct. 7, 2013

(65) Prior Publication Data

US 2015/0097679 A1 Apr. 9, 2015

(51) Int. Cl.

| | |
|---|---|
| ***G08B 17/00*** | (2006.01) |
| ***G08B 17/10*** | (2006.01) |
| ***G08B 17/113*** | (2006.01) |

(52) U.S. Cl.

CPC ..... *G08B 17/10* (2013.01); *G08B 17/113* (2013.01)

(58) Field of Classification Search

USPC ..... 340/628–631, 577, 578, 579, 691.1; 250/573, 381; 351/337, 338, 342; 374/208

See application file for complete search history.

(56) References Cited

U.S. PATENT DOCUMENTS

| | | | | | |
|---|---|---|---|---|---|
| 3,188,434 | A * | 6/1965 | Numayama | ..... | 337/317 |
| 4,651,140 | A * | 3/1987 | Duggan | ..... | 340/589 |
| 4,786,811 | A * | 11/1988 | Sasaki | ..... | 250/385.1 |
| 4,937,562 | A * | 6/1990 | Kaminaka et al. | ..... | 340/693.6 |
| 5,486,816 | A * | 1/1996 | Ariga et al. | ..... | 340/630 |
| 6,057,775 | A * | 5/2000 | Sakurai et al. | ..... | 340/629 |
| 6,324,899 | B1 * | 12/2001 | Discenzo | ..... | 73/53.05 |
| 6,756,905 | B2 * | 6/2004 | Rattman et al. | ..... | 340/630 |
| 2009/0128821 | A1 * | 5/2009 | Sugimoto | ..... | 356/438 |
| 2013/0008787 | A1 * | 1/2013 | Mammoto et al. | ..... | 204/407 |

FOREIGN PATENT DOCUMENTS

| | | | |
|---|---|---|---|
| EP | 0 569 712 | A1 | 11/1993 |
| EP | 0 836 164 | A1 | 4/1998 |
| EP | 1 881 469 | A1 | 1/2008 |
| GB | 1 476 736 | | 6/1977 |
| WO | 2012/176028 | A1 | 12/2012 |

OTHER PUBLICATIONS

Extended European Search Report and Search Opinion, dated Feb. 24, 2015, from counterpart European Application No. 14187813.2.

* cited by examiner

*Primary Examiner* — George Bugg

*Assistant Examiner* — Edny Labbees

(74) *Attorney, Agent, or Firm* — Houston & Associates, LLP

(57) ABSTRACT

A smoke detector system that includes an airflow barrier installed between a detector base unit and a mounting surface to ensure there is separation between the detector base unit and the mounting surface. The barrier isolates and seals the smoke detector to prevent the formation of condensation in or around the smoke detector. The barrier further includes a cavity that can collect condensation if condensation does occur. The condensation is then directed to a channel that extends around the periphery of the airflow barrier. Additionally, the channel includes weep holes so that condensation has a means to exit the detector.

14 Claims, 4 Drawing Sheets

SMOKE DETECTOR WITH AIRFLOW BARRIER

BACKGROUND OF THE INVENTION

Smoke detectors are often used for monitoring areas inside of buildings such as houses, office buildings, warehouses, or casinos, to list a few examples. The detectors are typically installed on mounting surfaces (e.g., walls or ceilings) of the buildings and typically connect to power sources. The smoke detectors monitor the surrounding air for smoke or other indicators of fire and generate an alarm if smoke and/or other indicators of fire are detected. The alarm may be an audible tone, a visual warning (e.g., flashing lights), and/or a signal sent to a fire control panel, which may then be directed to a fire department and other building alarm systems. In some cases, the smoke detectors further include a relay for closing a nearby fire door, for example.

SUMMARY OF THE INVENTION

One problem with smoke detectors that are installed on mounting surfaces is that the temperature and moisture content of air behind the mounting surfaces are often different than the temperature and moisture content of air surrounding the smoke detectors. For example, in an office building it common for heating and/or cooling ducts to be routed through the walls or above a suspended ceiling, but rooms within the office building will be climate controlled. The space above the suspected ceiling may not even be climate controlled to any significant degree. Associated problems can be magnified when an electrical box, to which the detector is mounted, is not flush with the wall or additional knockouts have been removed from the electrical box. This facilitates airflow around the smoke detector and the unconditioned space behind the mounting surface.

When air at different temperatures meet, condensation can form. In the case of the air meeting around smoke detectors, the condensation can form on or within the detectors. This condensation can cause corrosion or damage to electrical wiring and electronic components of the detectors. In many cases, the damage will require the detectors to be serviced or replaced.

One previous solution to solve the condensation problem used a flat piece of rubber to act as a barrier between the mounting surface and the detector. This solution, however, did not always ensure that detectors would sit flat against the mounting surface. Additionally, this previous solution could trap moisture around the detector if condensation did occur.

The present system is directed to an airflow barrier, which is comprised of a ring barrier and gasket, to ensure that there is a separation between a detector base unit and a mounting surface. Additionally, this airflow barrier creates a cavity and/or channel between mounting surface and the gasket of the airflow barrier to collect condensation (if condensation occurs) and then drain it to a channel, which preferably extends around the perimeter of the barrier. The channel includes weep holes so that the condensation has a means to exit.

In general, according to one aspect, the invention includes a detector system comprising a smoke detection engine for detecting smoke and a base unit for mounting the smoke detection engine to a mounting surface. The detector system further includes an airflow barrier connected to the base unit that creates a cavity and/or channel between the airflow barrier and the mounting surface when the airflow barrier is installed against the mounting surface. Additionally, the airflow barrier includes a channel on a periphery of the airflow barrier that receives fluids from the cavity.

In general, according to another aspect, the invention features a method for implementing a detector system. The method includes providing a detector base unit, which includes a smoke detection engine. The method further includes installing an airflow barrier between a mounting surface and the detector base unit. The airflow barrier creates a cavity and/or channel between the airflow barrier and the mounting surface. Additionally, the airflow barrier includes a channel on a periphery of the airflow barrier that receives fluids from the cavity.

The above and other features of the invention including various novel details of construction and combinations of parts, and other advantages, will now be more particularly described with reference to the accompanying drawings and pointed out in the claims. It will be understood that the particular method and device embodying the invention are shown by way of illustration and not as a limitation of the invention. The principles and features of this invention may be employed in various and numerous embodiments without departing from the scope of the invention.

BRIEF DESCRIPTION OF THE DRAWINGS

In the accompanying drawings, reference characters refer to the same parts throughout the different views. The drawings are not necessarily to scale; emphasis has instead been placed upon illustrating the principles of the invention. Of the drawings.

DETAILED DESCRIPTION OF THE PREFERRED EMBODIMENTS

The invention now will be described more fully hereinafter with reference to the accompanying drawings, in which illustrative embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art.

As used herein, the term "and/or" includes any and all combinations of one or more of the associated listed items. Further, the singular forms of the articles "a", "an" and "the" are intended to include the plural forms as well, unless expressly stated otherwise. It will be further understood that the terms: includes, comprises, including and/or comprising, when used in this specification, specify the presence of stated features, integers, steps, operations, elements, and/or components, but do not preclude the presence or addition of one or more other features, integers, steps, operations, elements, components, and/or groups thereof. Further, it will be understood that when an element, including component or subsystem, is referred to and/or shown as being connected or coupled to another element, it can be directly connected or coupled to the other element or intervening elements may be present.

Figure 1:
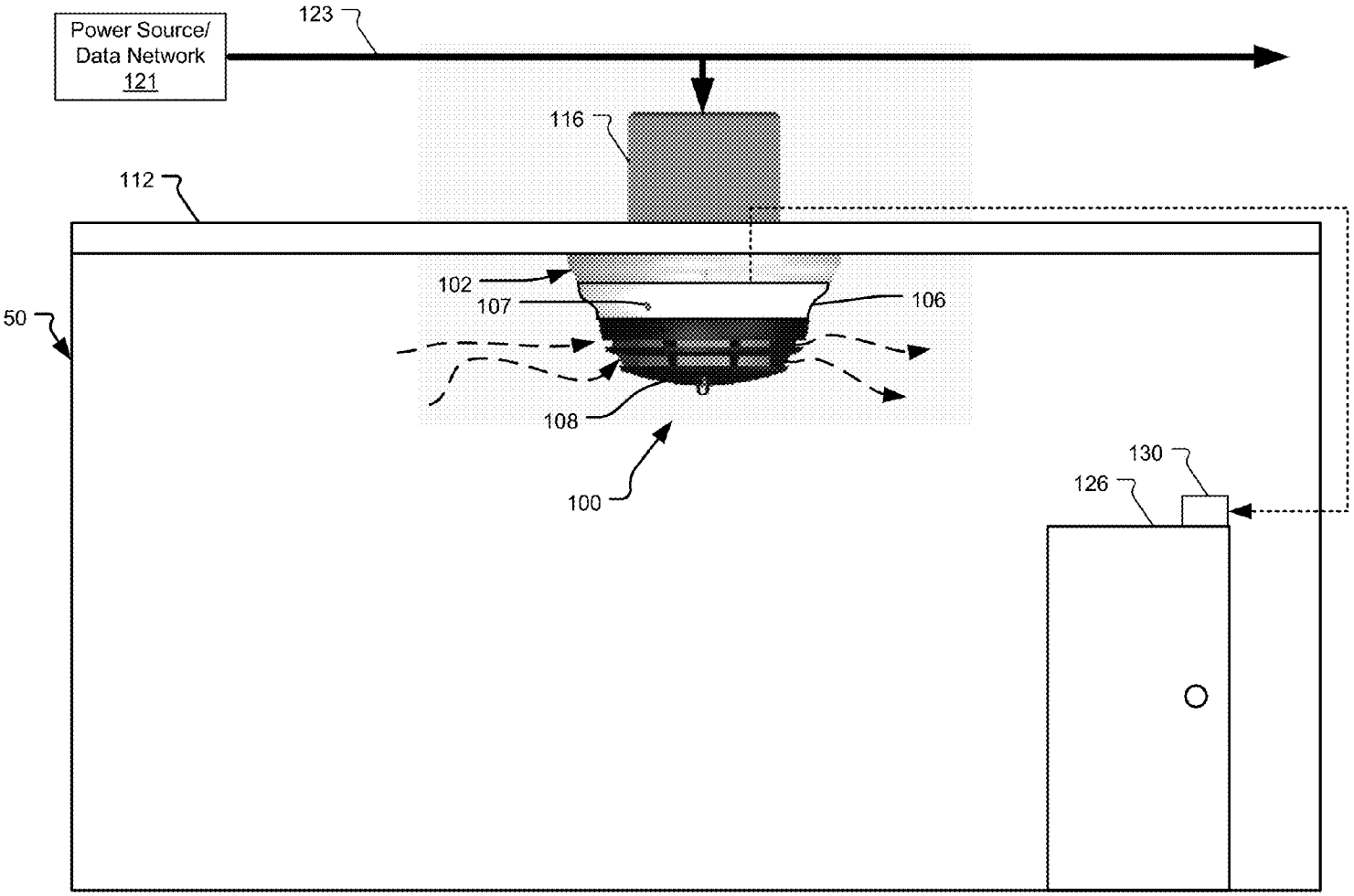
FIG. 1 illustrates an example of a smoke detector installed on a mounting surface of a room.

FIG. 1 illustrates an example of an inventive smoke detector 100 installed on a mounting surface (e.g., a wall or ceiling) 112 of a room 50. Typically, the room 50 is within an office, a government building, a school or university, a warehouse, a hospital, a casino, or a house, to list a few examples.

In general, the housing of the smoke detector 100 is comprised of three main components: an airflow barrier 102, a detector base unit 106, and a detector head unit 108.

The airflow barrier 102 provides separation between the detector base unit 106 and the mounting surface 112, such as a ceiling tile of a suspended ceiling. The separation helps isolate the detector base unit 106 from the mounting surface and prevent the formation of condensation in or around the smoke detector 100. In some scenarios, however, the formation of condensation is unavoidable. In the event that condensation does form, the airflow barrier 102 seals the detector base unit 106 from the mounting surface 112 to prevent condensation from seeping into the detector base unit 106 (and detector head unit 108).

Typically, the airflow barrier 102 is molded to be compatible with the detector base unit 106. Shaping the airflow barrier 102 to the detector base unit 106 minimizes the possibility of gaps between the detector base unit 106 and the airflow barrier 102, which reduces the possibility of leaks between the airflow barrier 102 and the detector base unit 106. Additionally, it also prevents outside contaminants such as dirt and dust from entering the detector base unit 106.

The detector base unit 106 is installed below the airflow flow barrier 102. In the illustrated example, the detector base unit 106 includes a notification light 107 such as a light emitting diode (LED), which provides a visual indicator that the smoke detector 100 is powered and operating correctly. During an alarm, the notification light 107 may flash repeatedly to provide a visual warning.

The detector head unit 108 is attached to the detector base unit 106. Air (shown as arrows with dashed lines) enters vents 110 of a detector head unit 108 and is analyzed for indicators of fire. The smoke detector will generate an audio or visual alarm if indicators of fire are detected.

The detector head unit 108 and detector base unit 106 receive power from and communicate via a power source/data network 121. Power and data are carried via electrical wiring 123, which is routed through an electrical box (or junction box) 116. Typically, the electrical box 116 is a metal or plastic box installed in or behind the mounting surface 112.

In the illustrated example, the smoke detector 100 is connected to a relay 130 that controls a fire door 126. Upon detection of smoke, the smoke detector 100 sends a signal to the relay 130 to close the fire door 126. Alternatively, the smoke detector 100 could be connected to other devices such as a fire control panel or sprinkler system.

Figure 2:
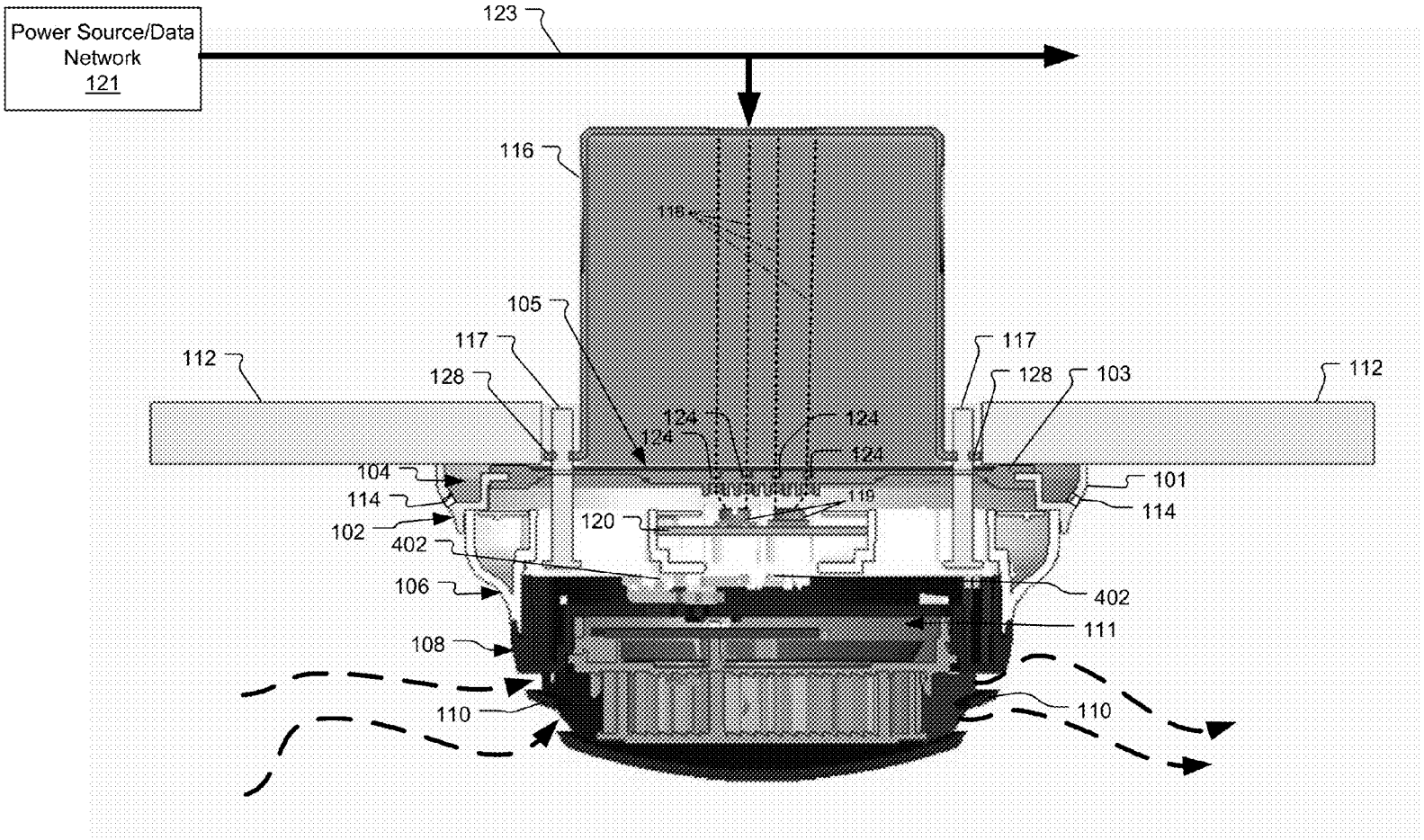
FIG. 2 is a cross section of the smoke detector and illustrates a detector head unit, a detector base unit, and an airflow barrier.

FIG. 2 is a cross section of the smoke detector 100 that further illustrates the detector head unit 108, the detector base unit 106, and the airflow barrier 102.

In a preferred embodiment, the airflow barrier 102 is comprised of a ring barrier 101 and a gasket 103, which is seated within a center portion of the ring barrier 101. The ring barrier 101 is fabricated from non-rigid materials such as plastic, rubber, or silicone, to list a few examples. This enables the ring barrier 101 to provide a stable surface on which the detector base 106 is mounted, but also enables the ring barrier 101 to flex and be mounted flush against uneven surfaces.

The gasket 103 is fabricated from a non-permeable material such as rubber, silicone, or plastic to prevent condensation from seeping into the detection base unit 106. The gasket 103 further includes pass through locations 124, which allow wires 118 to puncture the gasket 103 while forming a seal around the wires 118. This prevents condensation or other containments from seeping into the detector base unit 106.

The gasket 103 also includes areas to allow installation hardware 117 to puncture the gasket 103 and fasten the detector base unit 106 to an electrical outlet box 116 while forming a seal around the installation hardware to prevent fluids from seeping into the detection base unit 106.

In the current embodiment, the gasket 103 is slightly recessed compared to the ring barrier 101. The gasket 103 is slightly recessed to create a cavity 105 between the ring barrier 101 and the mounting surface 112. The cavity 105 collects condensation, which overflows into or is directed to the ring barrier 101 and the weep holes 114. Additionally, the existence of the cavity enables the ring barrier 101 to mount flush against uneven surfaces. In other examples, no cavity is present. Instead only channel(s) or dome shaped structure(s) are provided to direct fluids (water) away from any wires and toward ring barrier and the weep holes.

A channel 104 is on a periphery of the ring barrier 101 and is connected to the cavity 105 to receive fluids from cavity 105. In a typical implementation, the channel 104 includes the weep holes 114, which provide a means for the fluids to drain from the channel 104.

The detector base unit 106 includes installation hardware 117 to secure the detector base unit 106 to the electrical box 116. The electrical box 116 includes screw holes 128 for receiving screws, fasteners, or other installation hardware. In a typical implementation, the installation hardware 117 of the detector base unit 106 secures the airflow barrier 102 in place against the mounting surface 112.

A circuit board 120 of the detector base unit 106 includes data network interface chips and address information for the detector 100, which enables the determination of the location where the smoke detector 100 is installed because building or large rooms often include several smoke detectors. This address information helps pinpoint where a fire is located.

Power and/or data are carried from the power source/data network 121 to the smoke detector 100 via wiring 123, which is routed to the electrical box 116. The wiring 123 is separated into the individual lines and connected to terminating screws 119 on the circuit board 120. In a typical implementation, the electrical wiring 118 is comprised of four separate lines: a positive wire and a negative wire "arriving" from a fire alarm control panel or detector and a positive wire and a negative wire "leaving" for a next detector. This configuration allows multiple smoke detectors within a building or room to be interconnected and/or communicate with the fire alarm control panel.

The detector base unit 106 further includes contact points 402 to interface with the detector head unit 108.

The detector head unit 108 includes a smoke detection engine 111 that analyzes the surrounding air for indicators of fire. Examples of smoke detector engines include optical detectors, ionization detectors, or air-sampling detectors, to list a few examples. If indicators of fire or specifically smoke are detected, then an alarm is generated. While not shown in the illustrated example, the detector head unit 108 also includes speakers and/or strobe lights to generate warnings when an alarm is generated, in some embodiments.

Figure 3:
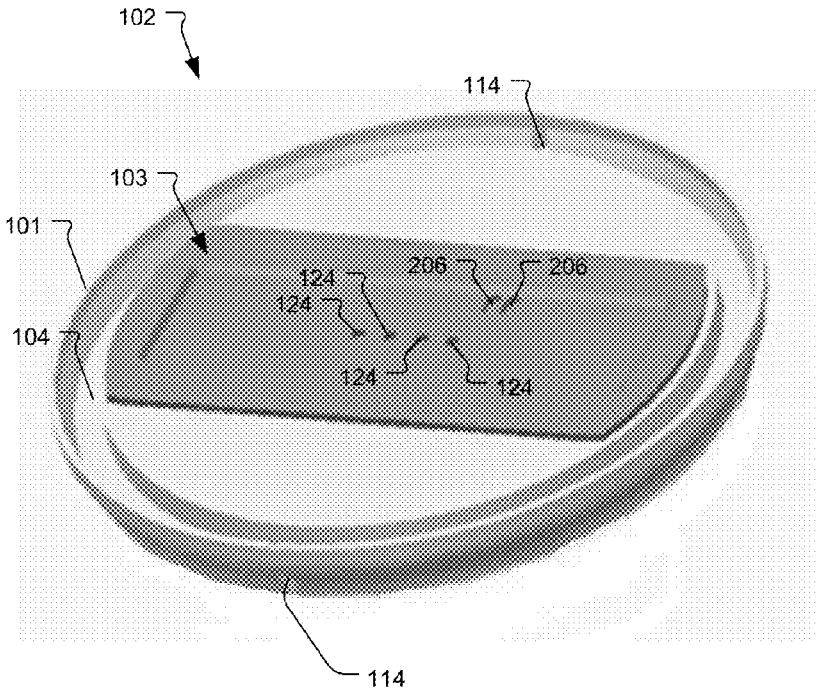
FIG. 3 is a perspective view further illustrating a back side of the airflow barrier and a channel.

FIG. 3 is a perspective view further illustrating a back side of the airflow barrier 102 and the channel 104.

The illustrated example shows how the channel 104 extends about the periphery of the ring barrier 101. Additionally, the illustrated example further shows the weep holes 114. While the illustrated embodiment only shows two weep holes, additional weep holes or only a single hole may be implemented in alternative embodiments.

The illustrated example further shows the gasket 103 and the pass-through locations 124. In the illustrated example, the gasket 103 further includes secondary pass through locations 206, which enable the smoke detector to connect to other devices for additional functionality. In one example, the secondary pass through locations 206 are utilized to connect the smoke detector 100 to the relay that closes the fire door.

Figure 4:
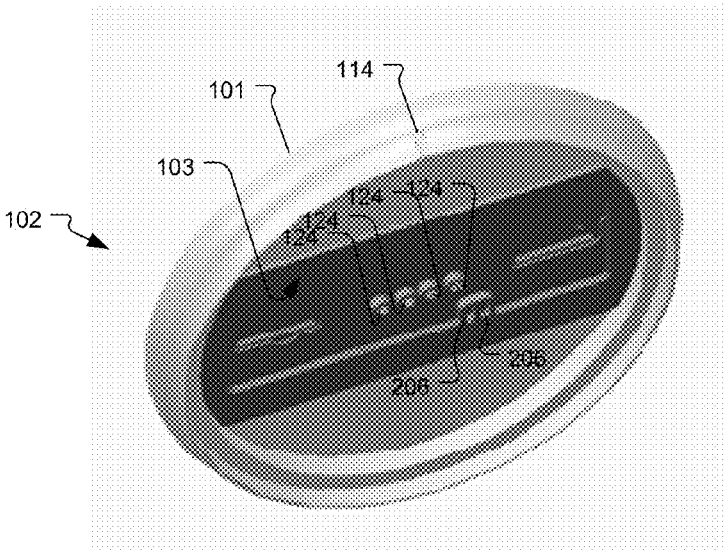
FIG. 4 is a perspective view illustrating a front side of the airflow barrier and a gasket installed in the airflow barrier.

FIG. 4 is a perspective view illustrating a front side of the airflow barrier 102 and the gasket 102 installed in the ring barrier 101.

The illustrated example provides a front view of the gasket 103, pass-through locations 124, and secondary pass-through locations 206.

Figure 5:
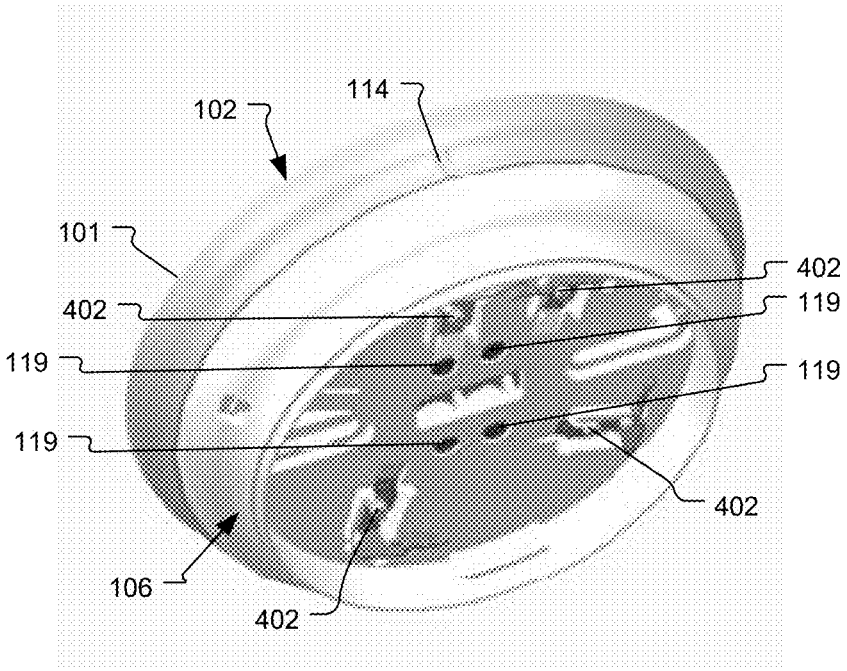
FIG. 5 is a perspective view illustrating a front side of the detection base unit, which includes contact points to interface with the detection head unit.

FIG. 5 is a perspective view illustrating a front side of the detection base unit 106 of the smoke detector 100, which includes contact points 402 to interface with the detection head unit 108.

When the detector head unit 108 is attached to the detector base unit 106, contact points 402 of the detector base unit 106 interface with connections of the detection head 108 (not shown in the figures). Typically the location of the contact points 402 in the detector base unit 106 is standardized to enable detector head units from (that are the same make and model) to be interchangeable.

While the present system is directed to an example of a smoke detector 100, other devices such as carbon monoxide/dioxide detectors, motion sensors, and light fixtures could implement features of the present system.

While this invention has been particularly shown and described with references to preferred embodiments thereof, it will be understood by those skilled in the art that various changes in form and details may be made therein without departing from the scope of the invention encompassed by the appended claims.

What is claimed is:

1. A detector system comprising:

a smoke detection engine for detecting smoke;

a detector base unit for mounting the smoke detection engine to a mounting surface; and an airflow barrier between the mounting surface and the detector base unit;

wherein the airflow barrier includes a channel on a periphery of the airflow barrier that receives fluids and the airflow barrier is comprised of outer barrier and a gasket that is seated in a center portion of the outer barrier, in which the gasket includes pass through locations to allow installation hardware and/or wires to puncture the gasket while forming a seal around the installation hardware and/or wires to prevent the fluids from entering the detector base unit.

2. The system according to claim 1, wherein the channel includes one or more weep holes within the channel to drain the received fluids from the channel.

3. The system according to claim 1, wherein the gasket is fabricated from rubber, silicone, or plastic.

4. The system according to claim 1, wherein the detector base unit includes contact points to interface with the smoke detection engine.

5. The system according to claim 1, wherein the detector base unit is connected to a relay that controls a fire door.

6. The system according to claim 1, wherein the airflow barrier creates a cavity between the mounting surface and the airflow barrier to collect fluids.

7. The system according to claim 6, wherein a center portion of the airflow barrier is recessed to create the cavity.

8. The system according to claim 1, wherein the airflow barrier is dome shaped to direct the fluids toward the channel on the periphery of the airflow barrier.

9. A method for implementing a detector system, the method comprising:

providing a smoke detection engine for detecting smoke;

mounting the smoke detection engine to a detector base unit, which is installed mounted to a mounting surface;

installing an airflow barrier between the mounting surface and the detector base unit; and wherein the airflow barrier includes a channel on a periphery of the airflow barrier that receives fluids and the airflow barrier is comprised of an outer barrier and a gasket that is seated in a center portion of the outer barrier, in which the gasket includes pass through locations to allow installation hardware and/or wires to puncture the gasket while forming a seal around the installation hardware and/or wires to prevent the fluids from entering the detector base unit.

10. The method according to claim 9, wherein the channel includes one or more weep holes to drain the received fluids from the channel.

11. The method according to claim 9, further comprising connecting the detector base unit to a relay that controls a fire door.

12. The method according to claim 9, wherein the airflow barrier creates a cavity between the mounting surface and the airflow barrier to collect fluids.

13. The method according to claim 12, wherein a center portion of the airflow barrier is recessed to create the cavity.

14. The method according to claim 9, wherein the airflow barrier is dome shaped to direct the fluids toward the channel on the periphery of the airflow barrier.

* * * * *